United States Patent [19]

Chung

[11] Patent Number: 4,572,863

[45] Date of Patent: Feb. 25, 1986

[54] AQUEOUS POLYESTER/EPOXY EMULSION TREATMENT FOR YARN, METHOD OF PREPARATION AND A RUBBER/CORD COMPOSITE

[75] Inventor: Daniel A. Chung, North Canton, Ohio

[73] Assignee: The Goodyear Tire & Rubber Company, Akron, Ohio

[21] Appl. No.: 759,726

[22] Filed: Jul. 29, 1985

[51] Int. Cl.[4] ..... B32B 7/00

[52] U.S. Cl. ..... 428/250; 152/359; 152/548; 156/315; 156/910; 427/381; 427/389.9; 427/412; 428/246; 428/252; 428/265; 428/395; 428/492; 523/414; 523/415

[58] Field of Search ..... 156/910, 315; 152/359; 523/414, 415; 427/389.9, 381, 412; 428/252, 265, 395, 246, 250, 492

[56] References Cited

U.S. PATENT DOCUMENTS

| | | | |
|---|---|---|---|
| 3,817,918 | 6/1974 | Aufdermarsh | 523/415 |
| 3,933,677 | 1/1976 | Aufdermarsh | 523/415 |
| 4,356,219 | 10/1982 | Boon et al. | 427/386 |
| 4,448,813 | 5/1984 | Solomon | 427/389.9 |
| 4,462,855 | 7/1984 | Yankowsky et al. | 156/910 |
| 4,472,463 | 9/1984 | Solomon | 427/381 |

FOREIGN PATENT DOCUMENTS

| | | | |
|---|---|---|---|
| 2127829 | 4/1984 | United Kingdom | 523/415 |

*Primary Examiner*—James J. Bell
*Attorney, Agent, or Firm*—D. O. Nickey

[57] ABSTRACT

There is disclosed a method for the treatment of yarn which comprises applying an aqueous emulsion of a polyester/epoxy adhesive to the yarn. The polyester-/epoxy adhesive comprises a water emulsifiable polyester capped with an isocyanate group and an epoxide which is dispersed in water to form an emulsion.

17 Claims, No Drawings

AQUEOUS POLYESTER/EPOXY EMULSION TREATMENT FOR YARN, METHOD OF PREPARATION AND A RUBBER/CORD COMPOSITE

TECHNICAL FIELD

This invention relates to adhering yarn and/or cord of multiple yarns thereof to rubber. The invention more specifically relates to the treatment of polyester yarn with an aqueous emulsion of an isocyanate capped polyester/epoxide adhesive.

BACKGROUND ART

Composites of fiber-reinforced rubber are useful for many purposes including pneumatic tires and industrial belts. Typically, such reinforcing fibers are in the form of a cord comprised of cabled and twisted yarns. Such fibers can be of various materials including nylons, polyester, wire, rayon, cotton and glass.

An important requirement of such reinforced rubber composites is the adhesion of the reinforcing fiber or cord to the rubber itself. Such adhesion is of particular importance where the resulting composite is subjected to considerable flexing and distortion, such as the contortions encountered in the typical operation and use of pneumatic tires and industrial belts.

Various methods have been proposed and used to obtain adhesion of fiber or cord to rubber. For example, the cord has been pretreated prior to adhering to rubber by dipping, followed by drying, in an aqueous emulsion comprised of a resorcinol/formaldehyde latex (RFL), a latex treatment well-known to those having skill in the art, in which the resorcinol/formaldehyde resin is a part of an aqueous latex, usually a butadiene/styrene/vinylpyridine terpolymer. The resorcinol/formaldehyde resin is understood to be a primary element of the adhesive between the cord and the rubber with the latex being useful in reducing the modulus of the resin. Other advantages and features of the RFL for adhering cord to rubber are generally well-known to those having skill in the art.

While numerous methods are used to improve the adhesion of nylon, wire, rayon, cotton and glass to rubber, polyester fiber reinforcement has proven to be especially difficult. Polyester tire yarn requires the application of an adhesive layer to obtain bonding to the rubber. Two types of adhesive systems, a single dip and a double dip adhesive system, have been developed to meet this need.

In the double dip system, polyester yarn is treated with a first dip which is a dispersion of a phenol-block methylene bis phenylene diisocyanate, an epoxy resin, wetting agents and water. The treated cord is cured, then treated with a second dip of resorcinol-formaldehyde-latex and cured again.

In the single dip system, the adhesive layer is applied to the polyester yarn subsequent to drawing of the yarn. The polyester yarn is piled into cords which are treated with a resorcinol-formaldehyde-latex dip and cured. The need for the diisocyanate dip in cord processing is eliminated by the system. Low carboxyl polyester yarn treated with this system has very good ammonolytic and hydrolytic stability, but has poor adhesion to rubber when made into tire cord.

U.S. Pat. No. 4,356,219 relates to a method for preparing drawn, coated polyester yarn which comprises applying an aqueous emulsion of an epoxy resin and spin finish fiber treatment oil to spun or drawn yarn. The oil is comprised of a mixture of pentaerythritol tetraester fatty acid, polyoxyethylenenonyl phenol and oleyl diethyl imidazoleimium sulfate.

U.S. Pat. No. 4,300,615 claims the use of an adhesive dip for reinforcing fabrics which contains an antidegradant.

U.S. Pat. No. 4,472,463 discloses a second step dip for coating a cord or fabric made of polyester, wherein the dip is an aqueous emulsion containing an adhesive latex of a diene polymer and an acrylic resin.

European Patent Application Publication Number 0119948 discloses a polyester yarn having a coating thereon comprised of (A) a specified fiber treatment oil and (B) an epoxy resin containing a specified dioxaborinane.

U.S. Pat. No. 3,749,758 relates to compositions comprising carboxyl containing polyesters (prepared by the reaction of a dicarboxylic acid and a 2,2-di-(hydroxymethyl)carboxylic acid), and di- and/or polyepoxides.

U.S. Pat. No. 3,301,804 teaches that tire yarns treated with an aqueous emulsion of an epoxy novalac and an amino boron catalyst have excellent adhesion to rubber. The adhesion is satisfactory in a static composite, however, in dynamic applications such as in a tire, the stiff and brittle epoxy novalac experiences a dramatic loss of adhesion.

The prior art does not suggest or disclose that significant increases in adhesion of polyester fiber to rubber can be achieved through treating the polyester fiber with an aqueous emulsion of an isocyanate terminated polyester and an epoxy resin.

DISCLOSURE OF THE INVENTION

It has been discovered that adhesion between polyester yarn or cord thereof to rubber can be enhanced by application of a composition to the yarn or cord prior to adhering to the rubber. The composition is an aqueous emulsion that can be applied to spun yarn after drawing of the yarn or after twisting and cabling of the drawn yarn to form the cord.

In accordance with this invention there is disclosed a drawn yarn composite which comprises a polyester yarn, optionally in the form of a multiple of twisted or cabled drawn yarns to form a cord or a fabric composed of said yarn, and a coating thereon, said coating comprised of:

(1) a water emulsifiable polyester that has been reacted with a diisocyanate;

(2) an epoxy resin; and (3) water.

There is further disclosed a process for the preparation of an aqueous emulsion of an isocyanate terminated polyester/epoxy mixture that is capable of increasing the adhesion of rubber to reinforcing fibers which comprises:

(a) reacting a water emulsifiable polyester with a hindered diisocyanate at a mole ratio of from 1.5:1 to 2.5:1, diisocyanate to polyester, to form a prepolymer:

(b) combining the prepolymer with an epoxy resin at a weight ratio of 2:1 to 20:1 prepolymer to epoxy resin; and then (c) adding this mixture to water under conditions of agitation to yield an emulsion with solids content from 2 to 50 parts by weight per 100 parts of emulsion.

There is also disclosed a textile fabric composite comprised of (A) a cord or fabric thereof composed of fibers of polyester and (B) an adhesive coating thereon formed by the steps of (1) applying an aqueous emulsion composition coating to said fabric and (2) drying the coated fabric, wherein said aqueous emulsion composition is prepared by the process which comprises:

(a) reacting a polyester with a hindered diisocyanate at a mole ratio of from 1.5:1 to 2.5:1 diisocyanate to polyester, to form a prepolymer:

(b) reacting the prepolymer with dimethylolpropionic acid, to form a water emulsifiable prepolymer;

(c) combining the water emulsifiable prepolymer with an epoxy resin at a weight ratio of 2:1 to 20:1 prepolymer to epoxy resin; and then (d) adding this mixture to water to yield an emulsion with solids content from 2 to 50 parts by weight per 100 parts of emulsion.

In addition, there is disclosed a composite comprised of a vulcanizable rubber selected from at least one of natural rubber, cis-1,4-polyisoprene, cis-1,4-polybutadiene, butadiene/styrene copolymers and butadiene/acrylonitrile copolymers, reinforced with the novel fabric composite of this invention.

The polyester yarn composite is prepared by application of the coating to spun or drawn polyester yarns or polyester fabrics. The yarn or fabric is preferably dipped into the coating at a temperature from 20° C. to 90° C., the excess coating is removed and then cured. The treated fabric may then be dipped into an RFL or other procedures performed upon it prior to its incorporation into a rubber article.

This invention is thus directed to (A) a treated yarn or fabric composite; (B) a rubber composite comprised of rubber reinforced with the treated yarn or fabric; and (C) a method for the preparation of the treated yarn.

Application of the emulsion to the yarn can be accomplished by conventional methods such as kiss roll application where the yarn is passed over and in contact with a rotating drum which has its lower portion immersed in the aqueous emulsion dip. The yarn is coated by the aqueous emulsion which is carried on the surface of the rotating drum. The drum itself is rotating in the same direction as the yarn but at a somewhat slower speed. Alternately, the emulsion can be metered directly onto the yarn or cord. The yarn or cord can then be passed through an oven to dry it by removing the moisture.

After drawn yarn has been thusly treated, it is subsequently twisted and cabled to produce a cord or fabric, or the cord or fabric without treatment after formation may be treated with the emulsion of this invention.

The cords prepared from such emulsion-coated yarns are then dipped, preferably on a continuous basis, in a resorcinol-formaldehyde resin/latex-type (RFL) dip. The cord, after dipping in the RFL, is dried by passing through an oven at about 230°-270° F. to reduce the water content of the coating.

The polyesters that can be used to form the yarns or fabrics that are treated by the present invention are the linear polyesters. Such polyesters are formed by the reaction of a glycol containing from 2 to 20 carbon atoms and a dicarboxylic acid component or a corresponding diester thereof containing at least about 75 percent terephthalic acid or a diester thereof, i.e. dimethylterephthalate. The remainder, if any, of the dicarboxylic acid component may be any suitable dicarboxylic acid such as sebacic acid, adipic acid, isophthalic acid, sulfonyl-4,4'-dibenzoic acid, or 2,8-di-benzofurandicarboxylic acid. The glycol may contain more than 2 carbon atoms in the chain, e.g., diethylene glycol, butylene glycol, decamethylene glycol, and bis-1,4-(hydroxy-methyl)cyclohexane. Examples of linear terephthalate polyesters which may be employed include poly(ethylene terephthalate), poly(butylene terephthalate), poly(ethylene terephthalate/5-chloroisophthalate), poly(ethylene terephthalate/5-[sodium sulfo]isophthalate), and poly(cyclohexane-1,4-dimethylene terephthalate/hexahydroterephthalate).

The epoxy portion of the polyester/epoxy emulsion of this invention can be any of various epoxy resins. Representative of epoxy resins useful in this invention are the glycidyl ethers of phenol novalacs and glycidyl ethers of bisphenol-A, as well as other epoxies such as glycidyl ethers based on oligomers from bisphenol-A and epichlorohydrin, diglycidyl ethers of catachol, resorcinol and hydroquinone and triglycidyl ethers of trimellitic and trimisic acid. Examples of commercially available epoxies which can be used in this invention are Ciba Geigy's EPN-1138 and Shell Chemical Company's EPON ® Resin 1001.

Epoxy resins are customarily not dispersible in water. It has been discovered that if a water emulsifiable polyester is mixed with an epoxy, the mixture can be readily dispersed in water to form a stable emulsion. In contravention to the prior art, it has been discovered that the use of an amino boric acid ester is not required to disperse the epoxy. U.S. Pat. No. 3,301,804 teaches that use of an amino boric acid ester is required to disperse an epoxy in water. The instant invention can be utilized with or without the use of an amino boric acid ester: however, no advantage is seen in the use of the amino boric acid esters.

The polyester portion of the polyester/epoxy emulsion of this invention can be any water emulsifiable liquid polyester. To achieve water dispersibility of the polyester it must contain some form of ionic character. One approach to a water emulsifiable polyester is to prepare the polyester using the sodium salt of 5-sulfoisophthalic acid (SIPA) as a monomer in conjunction with a usual polycarboxylic acid and polyol.

Another approach is to prepare low molecular weight polyesters capped with isocyanates and then react the isocyanate capped polyester with a compound that possesses ionic character. Representative of such a compound is dimethylolpropionic acid (DMPA).

One important aspect of the invention for either approach resides in the capping of the polyester or formation of a prepolymer with a diisocyanate.

The diisocyanates useful in this invention are those that are sterically hindered. Representative of the sterically hindered diisocyanates are m-tetramethyl xylene diisocyanate, p-tetramethyl xylene diisocyanate, and diisocyanates of the formula:

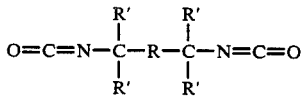

wherein R is selected from a straight chain saturated hydrocarbon of 2 to 4 carbon atoms; 1,3- and 1,4-disubstituted benzene rings and 4,4'-disubstituted diphenyl methane: and R′ is selected from hydrocarbon radicals of 1 to 3 carbon atoms.

Since the epoxy resin reacts with isocyanate, the choice of the diisocyanate is important since extended workable lifetimes of the aqueous polyester/epoxy emulsion are required for commercial utility. The stability or workable lifetime of the emulsion depends on the hindered nature of the isocyanate. Thus, m- and p-tetramethyl xylene diisocyanate are preferred diisocyanates.

m- and p-tetramethyl xylene diisocyanate (hereinafter m- or p-TMXDI) are available from American Cyanamid. TMXDI has the added desirability of being partially aromatic and yet it will produce a prepolymer that is more fluid than a totally aromatic diisocyanate such as 4,4′-diphenylmethene diisocyanate. The aliphatic character of TMXDI also offers excellent humidity resistance which is highly desirable in tire cord applications.

The molar ratio of TMXDI to polyester can range from 1.5:1 to 2.5:1 in the formation of the prepolymer. Preferably the ratio is 1.8:1 to 2.1:1. The weight ratio of prepolymer to epoxy can range from 2:1 to 20:1 with 5:1 being preferred.

The solids content of the final polyester/epoxy emulsion can range from 2 to 50 parts by weight per 100 parts of emulsion. For the treatment of yarn, the preferred range is 2 to 5 parts solids by weight per 100 parts emulsion.

The temperature of the treatment or dip of the yarn in the emulsion of this invention can be from 20° to 90° C. with 30° to 70° C. being preferred.

The practice of this invention is further illustrated by reference to the following examples which are intended to be representative rather than restrictive of the scope of the invention. Unless otherwise indicated, all parts and percentages are by weight.

Experimental I

A water emulsifiable liquid polyester was prepared using the sodium salt of 5-sulfo-isophthalic acid (SIPA) as the ionic source. A fluid product was obtained from diethylene glycol-isophthalic acid/azelaic acid/SIPA at a mole ratio of 100–42/50/8. The ionic liquid polyester was converted to a prepolymer by reacting with m-TMXDI. When the reaction was complete the temperature of the prepolymer was maintained at 85° C. A high molecular weight, epoxy-terminated bisphenol-A based resin (EPON 1001 ®) was heated to 121° C. The polyester prepolymer was combined with EPON 1001 ® according to the formulation in Table 1.

Before the combination of the liquid polyester prepolymer and EPON 1001 ®, water in a beaker was preheated to 45° C. Using a Dispersator to keep the water under high shear agitation, the hot polyester-epoxy mixture was poured in to make a white emulsion of 30% solids. Heating of the emulsion was then reduced and the temperature of the mixture was maintained at 35° C.

Strip adhesion samples were prepared by dipping a 6″×6″ (15 cm×15 cm) panel of square woven Dacron TM sail cloth PET, 6.30 oz. wt. (176.4 gms) in the white emulsion. The Dacron TM was dipped and dried three times. The coated fabric was then heated in an oven at 204° C. for ten minutes. After cooling, it was dipped in a resorcinol-formaldehyde emulsion (RFL) common in the rubber industry. The Dacron TM was then returned to the 204° C. oven for five minutes of activation. It was cooled again before dipping into another latex emulsion also common in the rubber industry. The last coat on Dacron TM was also heated at 204° C. for 5 minutes. The coated Dacron TM was then sandwiched between two panels of a 60/40 natural rubber-SBR blend wherein the SBR is 23.5% styrene. The entire assembly was cured in a press for 15 minutes at 154° C. and 10 tons pressure.

The samples showed excellent adhesion between the rubber and Dacron TM. Adhesion value of 53 pli (pounds per linear inch) was observed compared with 3.4 pli obtained for the control (no treatment of the Dacron TM before the standard dips) (Table 1). Further, tearing of the rubber on each side of the experimentally treated Dacron TM sample was observed.

In addition to the excellent adhesion properties the new polyester-epoxy emulsion was amazingly stable. This was most surprising since water is known to be detrimental to isocyanates. Apparently, the hydrophobic nature of the new polyester system and the sterically hindered nature of m-TMXDI delayed the penetration of the water molecules into the shielded isocyanate sites. After overnight storage (about 16 hours) at ambient temperatures the emulsion separated into two phases. But, the phases readily dispersed again on agitation by a Dispersator. The excellent adhesion property was maintained as long as 29 hours (Table 1).

TABLE 1

| LIQUID POLYESTER-EPOXY EMULSION | |
|---|---|
| Ionic Liquid Polyester, pbw* | 100 |
| m-TMXDI, pbw | 58 |
| EPON 1001 ®, pbw | 52 |
| Water, pbw | 490 |
| % Solids | 30 |
| Strip Adhesion, pli** | |
| Original (15 min old emulsion) | 53 |
| 4-Hour Old Emulsion | 64 |
| 29-Hour Old Emulsion | 62 |
| Control (no polyester/epoxy treatment) | 3.4 |

*Liquid polyester composition: diethylene glycol-isophthalic acid/azelaic acid/-SIPA @ 100-42/50/8 mole ratio; Hydroxyl #131.1; Acid #8.7.

**In all experimental cases there was significant rubber coverage on the Dacron TM after peeling. A control sample having the same construction but no emulsion treatment before RFL dips gave adhesion value of 3.4 pli with no rubber coverage.

Experimental II

As described in Experimental I, another mixture was prepared from EPON ® 1001 and the isocyanate-terminated liquid polyester of Experimental I except a catalyst, USB 110, an amino boric acid ester, was added to the polyester/epoxy mixture and stirred. Pouring into water to form the emulsion and the preparation of adhesion samples were the same as in Experimental I. Excellent adhesion between rubber and Dacron TM was observed. Despite the presence of the catalyst, the emulsion was stable for at least 23 hours based on the retention of its excellent adhesion properties (Table 2).

TABLE 2

| LIQUID POLYESTER-EPOXY EMULSION CATALYZED BY AN AMINO BORIC ACID ESTER | |
|---|---|
| Ionic Liquid Polyester Prepolymer (See Table 1), pbw | 100 |
| EPON 1001 ®, pbw | 33 |
| USB 110, pbw | 1.04 |
| Water, pbw | 224 |
| % Solids | 37 |
| Strip Adhesion, pli* | |
| Original | 66 |

TABLE 2-continued

| LIQUID POLYESTER-EPOXY EMULSION CATALYZED BY AN AMINO BORIC ACID ESTER | |
|---|---|
| 1-Hour Old Emulsion | 60 |
| 4-Hour Old Emulsion | 55 |
| 23-Hour Old Emulsion | 34 |
| Control | 3.4 |

*In the experimental cases there was significant rubber coverage on the Dacron TM after peeling.

From the data contained in Tables 1 and 2, it is evident that the novel aqueous polyester/epoxy emulsions were surprisingly stable and retained their excellent adhesion properties for as long as 29 hours (working lifetime). The coating cured to a flexible coating on Dacron TM fabric and showed significantly improved adhesion to rubber compared with Dacron TM without treatment by the emulsion of this invention.

Experimental III–VII

A liquid polyester ionomer was prepared by first converting a triethylene glycol-isophthalic acid/azelaic acid liquid polyester to an isocyanate-terminated prepolymer using m-tetramethyl xylene diisocyanate (m-TMXDI). The prepolymer was then partially extended with dimethylolpropionic acid (DMPA). Both the isocyanate group in the prepolymer and the carboxylic acid group in DMPA are too sterically hindered to react with each other. Hence, the reaction of the hydroxyl group in DMPA with isocyanate is preferred over the carboxylic acid/isocyanate reaction.

An aqueous emulsion was readily prepared from a mixture of the ionomer and an epoxy resin, EPON® 1001. In this case, water was made basic with triethylamine (TEA) before the addition of the ionomer/epoxy mixture. The complete formulation is given in Table 3.

The amount of DMPA used influenced the viscosity of the ionomer. DMPA is the source of the carboxylic acid groups controlling the emulsifiability of the liquid polyester. The viscosity of the ionomer increases as more DMPA is used to increase the solubility of a liquid polyester in water. An ionomer with a low level of DMPA of 30% of the available equivalent of isocyanate in the prepolymer, i.e., DMPA to prepolymer ratio of 0.30 (Experimental IV) was found to disperse just as readily as one at 0.50 DMPA level (Experimental III). The lower level of DMPA was preferred because it produced lower viscosity ionomer and emulsion.

The ionomer dispersed in water by salt formation between carboxylic acid group and TEA. Different levels of TEA ranging from 50% to as high as 115% (Experimental V) of the available amount of acid were used (Tables 3 and 4). An excess of tertiary amine would accelerate the polymerization of EPON® 1001 via base catalysis. A deficiency in tertiary amine yielded unneutralized carboxylic acid which would acid catalyze the polymerization of EPON® 1001. Emulsions formed readily with tertiary amine in excess or deficiency.

Strip adhesion samples were prepared from these emulsions using the rubber and fabric described above. Dacron TM was coated with the polyester/epoxy emulsions followed by an RFL dip. Excellent adhesion was observed in all cases with tearing of the rubber along the reinforcing fabric.

An important property a new adhesive activator must have is storage stability. When mixtures of liquid polyester ionomers and EPON® 1001 were dispersed in water basified with TEA, they were stable for about three hours if the temperature was kept at about 50° C. Phase separation began to appear after three hours.

Instead of making the water basic with TEA, another tertiary amine, USB 110 (amino boric acid ester) was shown to disperse a liquid polyester ionomer/epoxy mixture successfully (Experimental VI and VII). Excellent adhesion was observed. It was most surprising to find out that, if USB 110 was used in large excess (two times) of the stoichiometric amount, the emulsion remained fluid for five days before phase separation occurred.

TABLE 3

| FORMULATION AND PROPERTY OF AQUEOUS DMPA POLYESTER/EPOXY EMULSION | Ex. III |
|---|---|
| Triethylene glycol-isophthalic acid/ azelaic acid polyester, pbw* | 48.4 |
| m-TMXDI, pbw | 51.6 |
| DMPA, pbw | 6.52 |
| EPON ® 1001, pbw | 32.1 |
| Triethylamine, pbw | 2.41 |
| Water, pbw | 526.6 |
| Solids, % | 21 |
| DMPA/Prepolymer Ratio | 0.50 |
| TEA/Ionomer Ratio | 0.50 |
| Strip Adhesion, pli** | 65 |

*Acids at 50/50 mole ratio; OH #238.6, Acid #8.9.
**Dacron TM was treated with the liquid polyester emulsion followed by an RFL dip. Significant rubber coverage on Dacron TM was observed after peeling. A control sample having the same construction and using Dacron TM treated with only the standard RFL dips gave adhesion value of 3.4 pli with no rubber coverage after peeling.

TABLE 4

| AQUEOUS LPE IONOMER EMULSIONS WITH LOW LEVELS OF DMPA | Ex. IV | Ex. V |
|---|---|---|
| Polyester, pbw** | 48.4 | 48.4 |
| m-TMXDI, pbw | 51.6 | 51.6 |
| DMPA, pbw | 4.35 | 4.35 |
| EPON ® 1001, pbw | 29.0 | 29.0 |
| TEA, pbw | 2.95 | 3.78 |
| Water, pbw | 444 | 507 |
| Solids, % | 23 | 21 |
| DMPA/Prepolymer Ratio | 0.30 | 0.30 |
| TEA/Ionomer Ratio | 0.90 | 1.15 |
| Strip Adhesion, pli* | 68 | 67 |
| Emulsion Stability, Hrs | 2.5+ | (Not determined) |

*See footnote (**) in Table 3.
**See footnote (*) in Table 3.

TABLE 5

| IONOMERS DISPERSED AS USB 110 AQUEOUS EMULSIONS | Ex. VI | Ex. VII |
|---|---|---|
| Polyester, pbw** | 48.4 | 48.4 |
| DMPA, pbw | 4.35 | 4.35 |
| EPON ® 1001, pbw | 29.0 | 29.0 |
| USB 110, pbw | 5.45 | 12.21 |
| Water, pbw | 447 | 465 |
| Solids, % | 24 | 24 |
| DMPA/Prepolymer Ratio | 0.30 | 0.30 |
| USB 110/Ionomer Ratio | 0.90 | 2.01 |
| Strip Adhesion, pli* | 50 | 50 |
| Emulsion Stability, Days | Less than 1 | 5 |

*See footnote (**) in Table 3.
**See footnote (*) in Table 3.

From the data presented, it is evident that the emulsion of the instant invention provides enhanced adhesion of reinforcing fibers to rubber.

In commercial application the stability of the polyester/epoxy emulsion is very important. The stability of an aqueous liquid polyester/epoxy emulsion was determined by measuring its retention of isocyanate content and strip adhesion values against time. An uncatalyzed (no amino boric acid ester) emulsion retained 70% of its original isocyanate content after 29 hours of storage and its adhesion between Dacron TM and rubber was as good as the fresh emulsion. In the presence of a catalyst (USB 110) the emulsion retained about the same isocyanate content (79%) after 23 hours of storage while maintaining good adhesion properties.

The stability of these liquid polyester emulsions in water was most surprising. Apparently the hydrophobic character of the new liquid polyester systems and the sterically hindered nature of TMXDI delayed the penetration of the water molecules into the shielded isocyanate sites. In contrast, the life of the more common emulsions based on 4,4'-diphenylmethane diisocyanate (MDI) was reported to be only 2–3 hours.

While certain representative embodiments and details have been shown for the purpose of illustrating the invention, it will be apparent to those skilled in this art that various changes and modifications may be made therein without departing from the spirit or scope of the invention.

I claim:

1. A process for the preparation of an aqueous emulsion of an isocyanate terminated polyester/epoxy mixture that is capable of increasing the adhesion of rubber to reinforcing fibers which comprises:

(a) reacting a water emulsifiable polyester with a hindered diisocyanate at a mole ratio of from 1.5:1 to 2.5:1, diisocyanate to polyester, to form a prepolymer;

(b) combining the prepolymer with an epoxy resin at a weight ratio of 2:1 to 20:1 prepolymer to epoxy resin: and then (c) adding this mixture to water under conditions of agitation to yield an emulsion with solids content from 2 to 50 parts by weight per 100 parts of emulsion.

2. The process according to claim 1 wherein the water emulsifiable polyester is the reaction product of a mixture comprising diethylene glycol, isophthalic acid, azelaic acid, and the sodium salt of 5-sulfo-isophthalic acid.

3. The process according to claim 1 wherein the hindered diisocyanate is selected from the group consisting of m-tetramethyl xylene diisocyanate, p-tetramethyl xylene diisocyanate and diisocyanates of the formula:

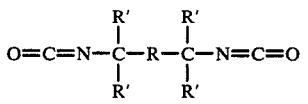

wherein R is selected from a straight chain saturated hydrocarbon of 2 to 4 carbon atoms; 1,3- and 1,4-disubstituted benzene rings and 4,4'-disubstituted diphenyl methane: and R' is selected from hydrocarbon radicals of 1 to 3 carbon atoms.

4. The process according to claim 1 wherein the epoxy resin is at least one epoxy resin selected from the group comprising glycidyl ethers of phenol novalac; glycidyl ethers of bisphenol-A: glycidyl ethers based on oligomers from bisphenol-A and epichlorohydrin; diglydicyl ethers of catachol, resorcinol and hydroquinone: and triglydicyl ethers of trimellitic and trimisic acid.

5. A textile fabric composite comprised of (A) a cord or fabric thereof composed of fibers of polyester and (B) an adhesive coating thereon formed by the steps of (1) applying an aqueous emulsion composition coating to said fabric and (2) drying the coated fabric, wherein said aqueous emulsion composition is prepared by the process which comprises:

(a) reacting a water emulsifiable polyester with a hindered diisocyanate at a mole ratio of from 1.5:1 to 2.5:1 diisocyanate to polyester, to form a prepolymer:

(b) combining the prepolymer with an epoxy resin at a weight ratio of 2:1 to 20:1 prepolymer to epoxy resin; and then (c) adding this mixture to water to yield an emulsion with solids content from 2 to 50 parts by weight per 100 parts of emulsion.

6. A composite comprised of a vulcanizable rubber selected from at least one of natural rubber, cis-1,4-polyisoprene, cis-1,4-polybutadiene, butadiene/styrene copolymers and butadiene/acrylonitrile copolymers, reinforced with the fabric composite of claim 5.

7. A fabric composite according to claim 5 wherein the fabric composite is used, at least in part, as reinforcement for a pneumatic tire.

8. The fabric composite of claim 5 wherein the fibers of polyester are fibers of polyethylene terephthalate.

9. The textile fabric composite of claim 5 wherein the epoxy resin is selected from glycidyl ethers of a phenol novalac and glycidyl ethers of bisphenol-A.

10. The textile fabric composite of claim 5 wherein the coated fabric is further treated by an aqueous RFL dip.

11. A textile fabric composite comprised of (A) a cord or fabric thereof composed of fibers of polyester and (B) an adhesive coating thereon formed by the steps of (1) applying an aqueous emulsion composition coating to said fabric and (2) drying the coated fabric, wherein said aqueous emulsion composition is prepared by the process which comprises:

(a) reacting a polyester with a hindered diisocyanate at a mole ratio of from 1.5:1 to 2.5:1, diisocyanate to polyester, to form a prepolymer:

(b) reacting the prepolymer with dimethylolpropionic acid, to form a water emulsifiable prepolymer;

(c) combining the water emulsifiable prepolymer with an epoxy resin at a weight ratio of 2:1 to 20:1 prepolymer to epoxy resin; and then (d) adding this mixture to water to yield an emulsion with solids content from 2 to 50 parts by weight per 100 parts of emulsion.

12. A composite comprised of a vulcanizable rubber selected from at least one of natural rubber, cis-1,4-polyisoprene, cis-1,4-polybutadiene, butadiene/styrene copolymers and butadiene/acrylonitrile copolymers, reinforced with the fabric composite of claim 11.

13. A fabric composite according to claim 11 wherein the fabric composite is used, at least in part, as reinforcement for a pneumatic tire.

14. The textile fabric composite of claim 11 wherein the fibers of polyester are fibers of polyethylene terephthalate.

15. The textile fabric composite of claim 11 wherein the epoxy resin is selected from glycidyl ethers of a phenol novalac and glycidyl ethers of bisphenol-A.

16. The textile fabric composite of claim 11 wherein the coated fabric is further treated by an aqueous RFL dip.

17. The textile fabric composite of claim 11 wherein the hindered diisocyanate is selected from the group consisting of m-tetramethyl xylene diisocyanate, p-tetramethyl xylene diisocyanate and diisocyanates of the formula:

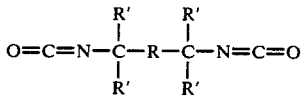

wherein R is selected from a straight chain saturated hydrocarbon of 2 to 4 carbon atoms 1,3- and 1,4-disubstituted benzene rings and 4,4'-disubstituted diphenyl methane: and R' is selected from hydrocarbon radicals of 1 to 3 carbon atoms.

* * * * *